US005925862A

United States Patent [19]

Morrisey, IV et al.

[11] Patent Number: 5,925,862

[45] Date of Patent: Jul. 20, 1999

[54] PROCESS FOR THE RECOVERY OF COBALT FROM ORES CONTAINING METAL SULFIDES

[75] Inventors: John C. Morrisey, IV, Viburnum; Quentin J. Schmidt, Davisville, both of Mo.

[73] Assignee: The Doe Run Company, St. Louis, Mo.

[21] Appl. No.: 08/976,189

[22] Filed: Nov. 21, 1997

[51] Int. Cl.[6] ..... B03D 1/06; B03D 1/02

[52] U.S. Cl. ..... 209/164; 209/166; 209/167; 241/24.13; 241/24.25

[58] Field of Search ..... 209/164, 166, 209/167; 241/24.13, 24.25

[56] References Cited

U.S. PATENT DOCUMENTS

| | | |
|---|---|---|
| 2,399,845 | 5/1946 | Allen et al. . |
| 3,570,772 | 3/1971 | Booth . |
| 4,460,459 | 7/1984 | Shaw et al. . |
| 4,511,540 | 4/1985 | Crussard . |
| 5,182,014 | 1/1993 | Goodman . |

*Primary Examiner*—Thomas M. Lithgow
*Attorney, Agent, or Firm*—Howell & Haferkamp, L.C.

[57] ABSTRACT

A process for the production of cobalt concentrate from an ore containing metal sulfides including sulfides of lead, zinc, and cobalt. The ore is crushed and subjected to a lead and cobalt flotation to separate the lead and cobalt from the zinc and produce a bulk lead cobalt concentrate. The lead cobalt concentrate is then subjected to a cobalt flotation to separate the cobalt from the lead and produce a cobalt concentrate.

17 Claims, 1 Drawing Sheet

PROCESS FOR THE RECOVERY OF COBALT FROM ORES CONTAINING METAL SULFIDES

FIELD OF THE INVENTION

This invention relates to a process for production of cobalt from ores containing metal sulfides.

BACKGROUND OF THE INVENTION

Cobalt is an important commodity used primarily in high-technology fields where materials require high strength; resistance to heat, corrosion, abrasion, and wear; or superior magnetic properties. A significant portion of cobalt consumption is for non-metallic products such as dryers in paints, and in pigments, enamels, rubbers, and catalysts.

Most cobalt production is in Southern Africa, primarily in Zaire and in Zambia. The U.S. is almost totally dependent on imports for cobalt, having no significant primary production. However, lead ore reserves in Missouri are estimated to contain 200 million pounds of cobalt. Most of this cobalt is present as the mineral siegenite $(Ni, Co)_3 S_4$. Siegenite is a member of the linnaeite series of minerals, and sometimes contains some copper and iron. Missouri cobalt-bearing ores are often characterized as a complex interlocking of siegenite with chalcopyrite, sphalerite, and dolomite.

Flotation test work has indicated that cobalt minerals tend to be readily depressed by most metal sulfide depressants, and especially by cyanides. It has also been observed that the number of flotation cleaner stages appeared to adversely affect the recovery of siegenite into a cobalt concentrate. Because of these flotation properties, metallurgical test work usually focused on the depression of siegenite during flotation of other sulfide minerals, usually with cyanide chemicals, which tended to produce the most consistent results.

SUMMARY OF THE INVENTION

The present invention relates to the production of a cobalt concentrate from ores containing metal sulfides that employs a flotation separation of the cobalt. Generally the process of this invention comprises grinding ore containing sulfides of lead, zinc, and cobalt and forming a slurry. The lead and cobalt minerals (typically galena and siegenite) are floated to produce a combined lead and cobalt rougher concentrate and a tailing slurry. The tailing slurry is subjected to a zinc flotation to produce a zinc rougher concentrate and a final tailing slurry. The zinc rougher concentrate can be processed further into a zinc concentrate. The combined lead and cobalt rougher concentrate is processed further to produce a lead concentrate and a cobalt concentrate. More specifically, the combined lead and cobalt rougher concentrate is cleaned to form a cleaner concentrate, and this cleaner concentrate is then conditioned with causticized starch and sodium dichromate and sodium silicate in amounts effective to depress lead flotation. A glycol frother is added and the conditioned slurry is subjected to froth flotation at a pH of less than about 5 to produce a cobalt rougher concentrate. This cobalt rougher concentrate is then cleaned to produce cobalt concentrate.

DETAILED DESCRIPTION OF THE PREFERRED EMBODIMENT

Figure 1:
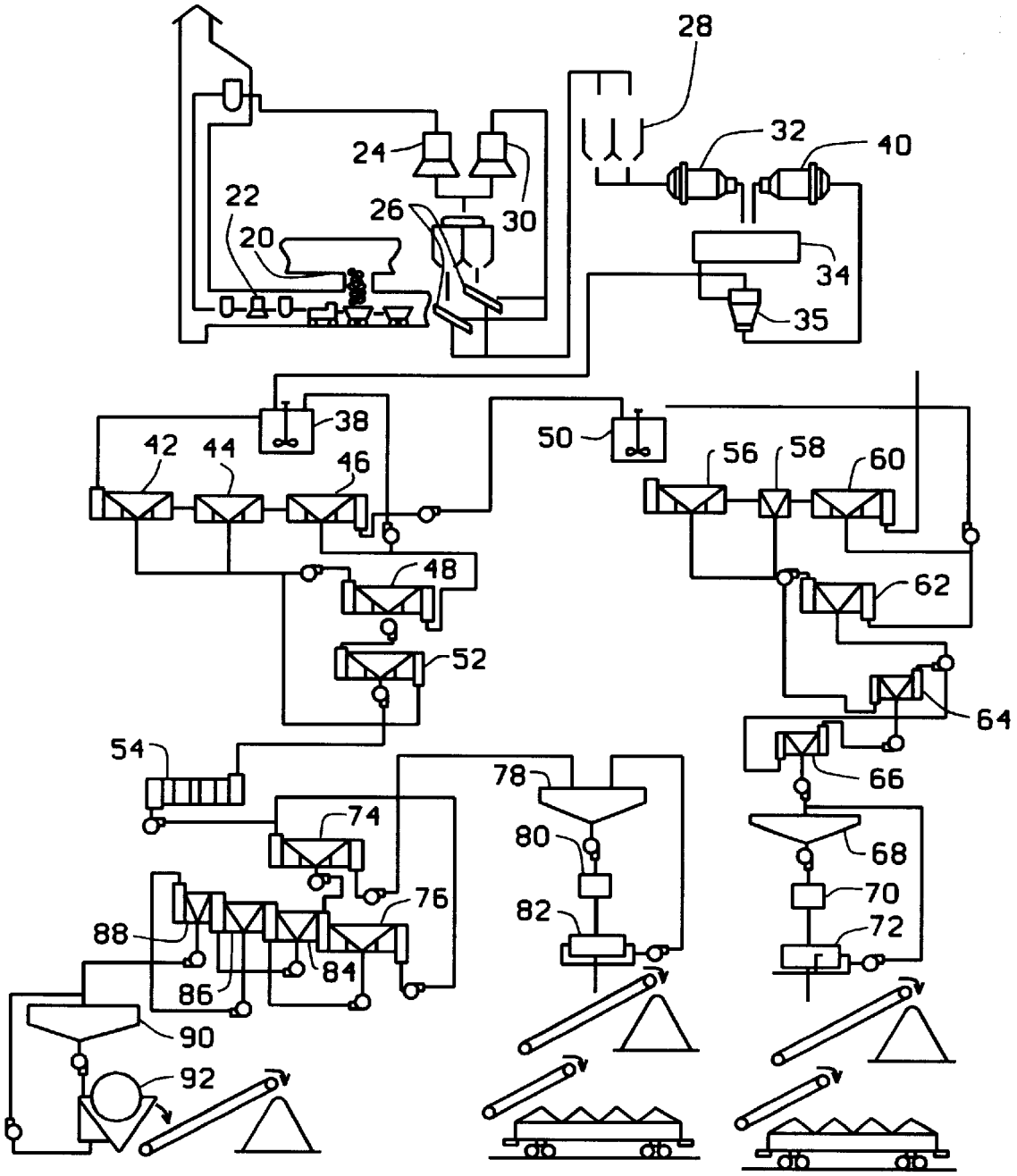

A process for the production of cobalt concentrate from an ore containing metal sulfides according to the principles of this invention is shown schematically in FIG. 1. At 20 the ore is extracted and is transported to primary crusher 22, where it is crushed. The crushed ore is then transported to the surface, to a secondary crusher 24, where it is further crushed. The crushed ore is then passed through screens 26. The fines (typically −¾ inch) are delivered to the fine ore bins 28, and the material that does not pass through the screens is routed to a tertiary crusher 30 and again passed through the screens 26.

Water and zinc sulphate (a depressant for sphalerite) and sodium isopropyl xanthate (a collector for metal sulfides such as galena and sphalerite) is added to the crushed ore from the bins 28, and the ore is ground in a rod mill 32. The slurry of ground ore from the rod mill 32 is conveyed to cyclone feed sump 34, and from the sump 34 the ground ore passes through one of a plurality of cyclones 36. The overflow from the cyclones 36 passes to a lead conditioner 38; the underflow from the cyclones, containing ore particles too large to pass with the overflow, is circulated back to the cyclone feed sump 34 after further grinding in ball mill 40.

The initial grinding and separation steps should be designed to limit the amount of gangue minerals (e.g. iron) in the lead concentrate. A fine size grind helps to ensure the liberation of the cobalt mineral from the other metal sulfides and the host rock. A particle size distribution of about 60% −200 mesh has been found to be satisfactory.

In the lead conditioner 38, methyl amyl alcohol (also known as methyl isobutyl carbinol) 4-methyl-2-pentanol, isobutyl methyl carbinol, or (a frothing agent) available from Van Waters & Rogers, Inc., Seattle, Wash., is added and the slurry is passed through lead roughers 42 and 44, and a lead scavenger 46, which in this preferred embodiment comprise a total of twelve cells. The methyl amyl alcohol is added in quantities of between about 0.02 and about 0.06 pounds/ton, at addition rates of between about 50 and about 150 cc/minute. There may be, and preferably are, more than one series of roughers 42 and 44 and scavenger 46 operating in parallel. The air flow in the roughers and the scavenger can generally be set to the manufacturers recommendations. The lead rougher froth from the lead roughers 42 and 44 is pumped to the lead first cleaner 48. The froth from the scavenger is recirculated to the lead conditioner 38. The tail from the lead scavenger 46 is pumped to a zinc conditioner 50.

The froth from the lead first cleaner 48 is pumped to a second lead cleaner 52. The tail from the lead first cleaner 48 is pumped back to the lead roughers 42 and 44 and scavengers 46, via the lead conditioner 38. The froth from the lead second cleaner 52 is delivered to a lead-cobalt conditioner 54. The tail from the lead second cleaner 52 is pumped back to the lead first cleaner 48.

In the zinc conditioner 50, sodium isopropyl xanthate (a primary collector for metal sulfides such as galena and sphalerite), methyl amyl alcohol or methyl isobutyl carbinol (a frothing agent), and ammoniated cupric chloride (an activator for sphalerite) is added. The sodium isopropyl xanthate is typically added in quantities of between about 0.002 and about 0.02 pounds/ton, at addition rates of between about 50 and about 500 cc/minute. The methyl amyl alcohol is typically added in quantities of between about 0.02 and about 0.06 pounds/ton, at addition rates of between about 50 and about 150 cc/minute. The ammoniated cupric chloride is typically added in quantities of between about 0.10 and about 0.52 pounds/ton, at addition rates of between about 200 and about 1000 cc/minute.

The conditioned slurry is delivered to zinc roughers 56 and 58 and zinc scavenger 60. The froth product from the roughers 56 and 58 is pumped to the zinc first cleaner 62.

The froth from the zinc scavenger 60 is recirculated to the zinc conditioner 50. The tail from the zinc scavenger 60 is discarded as waste tailings.

The froth from the zinc first cleaner 62 is pumped to the zinc second cleaner 64. The tail of the zinc first cleaner 62 is pumped back to the zinc conditioner 50. The froth from the zinc second cleaner 64 is pumped to a zinc third cleaner 66. The tail from the zinc second cleaner 64 is delivered to the zinc first cleaner 62. The froth from the zinc third cleaner 66 is pumped to a zinc thickener 68, and finally to a zinc filter 72, to remove water which is pumped back to the zinc thickener. (The material from the zinc thickener 68 could, optionally be sent to zinc blending tank 70 before passing the zinc filter 72). Bulk zinc concentrate is then collected from the zinc filter 72. The tail from the zinc third cleaner 66 is pumped back to the zinc second cleaner 64.

In the lead-cobalt conditioner 54, causticized starch, sodium silicate, and sodium dichromate are added $SO_2$ is added to reduce the pH to below about 5, and preferably to below about 4.8, and most preferably to a range of between about 4.5 to about 4.8. The causticized starch is preferably added in dosages two to three times the normal dosage in a conventional lead copper separation, e.g. between about 0.009 and about 0.109 pounds/ton, at rates between about 500 and about 6000 cc/min. The starch addition is initially set at a benchmark rate, for example 3000 cc/min, and is gradually reduced to obtain about 0.1% or less cobalt in the lead concentrate. The sodium silicate and the sodium dichromate are preferably added in equal amounts at quantities of between about 0.023 and about 0.137 pounds/ton, and at rates of between about 500 and about 3000 cc/min.

After conditioning, the material is then pumped to a cobalt rougher 74, which preferably comprises five cells. A frothing agent, and most preferably a non-water soluble glycol frothing agent such as N788 available from the Nottingham Chemical Company, Atlanta, Ga. is added. This frothing agent is added in quantities between about 0.002 and about 0.055 pounds/ton, and at rates of between about 5 and about 120 cc/min. The air flow in the rougher is preferably set at a benchmark mid range flow rate (the suitable flow rate depends on the type of rougher cell used, and is readily determined by those of ordinary skill in the art), and the rate of addition of the frother is adjusted to obtain the desired froth conditions. For example, air flow rate could be established at about 550 cfm (the particular equipment in this example generally operable between about 350 and about 650 cfm), and frother added in quantities of about 0.002 and about 0.009 pounds/ton, and more preferably about 0.005 pounds/ton. The rate of addition of the frother is then adjusted to obtain the desired froth condition.

The optimum recoveries of cobalt occurred in a five cell rougher in which the first two cells had relatively small, heavily laden bubbles of between about 1 and about 2 inches in diameter, the next two cells having a transition froth, and the last two cell having small, (about ¼ to about ½ inch), fast moving silver/white clear bubbles.

Once desired froth characteristics are achieved, further adjustments in the lead-cobalt rougher are preferably made by adjusting the air flow rate, until the circuit can no longer be controlled, at which point the air flow is reset to the benchmark, and the rate of addition of the frother adjusted.

The flotation product from the cobalt rougher 74 is pumped to a cobalt first cleaner 76, which in this preferred embodiment has three cells. The tail from the cobalt rougher 74 is pumped to the lead thickener 78, and from there to a lead filter splitter box 80, and finally through a lead filter 82, to remove water which is pumped back to the lead thickener 78. Bulk lead concentrate is then collected from the lead filter 82.

Starch is preferably also added to the cobalt first cleaner 76, in quantities of about 0.002 and about 0.02 pounds/ton, and at rates of between about 100 and about 1000 cc/min. The starch helps depress lead (galena) but excessive starch will also depress cobalt. The flotation product of the cobalt first cleaner 76 is pumped to the cobalt second cleaner cell 84, which in this preferred embodiment has two cells. The tail from the cobalt first cleaner 76 is pumped back to the cobalt rougher 74. The froth from the cobalt second cleaner 84 is pumped to the cobalt third cleaner 86, which has two cells. The tail from the cobalt second cleaner 84 is returned to the cobalt first cleaner 76.

Sodium silicate and sodium dichromate are preferably added to the cobalt third cleaner 86. The sodium silicate and the sodium dichromate are preferably added in equal amounts at quantities of between about 0.023 and about 0.091 pounds per ton, and at rates of between about 500 and about 2000 cc/min. The sodium silicate and sodium dichromate also act as a depressant for lead. The sodium silicate is preferably in the form of METSO BEADS®2048 available from the PQ Corporation, Valley Forge, Pa. The froth from the cobalt third cleaner 86 is pumped to the cobalt fourth cleaner 88, which in this preferred embodiment has one cell. The tail from the cobalt third cleaner 86 is returned to the cobalt second cleaner 84. The froth of the cobalt fourth 88 is delivered to a cobalt thickener 90 and from there to cobalt filter 92, to remove water which is pumped back to the cobalt thickener. The tail from the cobalt fourth cleaner 88 is delivered to the cobalt third cleaner 86.

The percentage of lead reporting in the cobalt concentrate, and the percentage of cobalt reporting in the lead concentrate provide feed back for operator control of the process. The process is preferably controlled to maintain 40% or less lead in the cobalt rougher froth. An increase in the lead reporting in the cobalt concentrate would initially be dealt with by adjusting the froth conditions in the rougher, and if that were not effective, by increasing the addition of the starch and sodium dichromate and sodium silicate to depress the lead. Similarly, an increase in the cobalt reporting in the lead concentrate would initially be dealt with by checking the froth conditions in the rougher, and adjusting the air flow rate if necessary. If this were not effective the amount of starch and sodium dichromate and sodium silicate is reduced.

EXAMPLE 8,929 tons of ore an average assay of 4.10% Pb, 0.24% Zn, 0.08% Cu, 1.96% Fe, and 0.08% Co was processed in accordance with the method of this invention in five shifts 90% of the cobalt from the ore reported to the bulk concentrate.

| ORE | MILL FEED | | COBALT CON. | | | LEAD CON. | |
|---|---|---|---|---|---|---|---|
| (tons) | Pb | Co | Pb | Co | COBALT REC. | Pb | Co |
| 1184 | 6.7 | 0.071 | 1.47 | 9.82 | 79.50% | 79.15 | 0.079 |
| 2315 | 3.97 | 0.074 | 2.83 | 12.97 | 73.90% | 79.00 | 0.241 |
| 2244 | 2.82 | 0.089 | 2.13 | 17.10 | 64.90% | 75.44 | 0.740 |
| 2162 | 3.80 | 0.090 | 1.71 | 17.74 | 50% | 77.29 | 0.766 |

-continued

| ORE | MILL FEED | | COBALT CON. | | | LEAD CON. | |
|---|---|---|---|---|---|---|---|
| (tons) | Pb | Co | Pb | Co | COBALT REC. | Pb | Co |
| 1024 | 4.79 | 0.078 | 1.85 | 13.80 | 70.90% | 79.09 | 0.203 |
| 8929 | 4.10 | 0.082 | 2.09 | 14.84 | 66.25 | 77.72 | 0.468 |

What is claimed is:

1. A process for the product ion of cobalt concentrate from an ore containing metal sulfides including sulfides of lead, zinc, and cobalt, the process comprising:

subjecting the ore to a lead and cobalt flotation to separate the lead and cobalt from the zinc and produce a bulk lead cobalt concentrate;

subjecting the lead cobalt concentrate to a cobalt flotation to separate the cobalt from the lead and produce a cobalt concentrate.

2. The process according to claim 1 further comprising flotation product of the cobalt flotation to at least one cleaning step.

3. The process according to claim 1 wherein the cobalt flotation is conducted in the presence of starch in an amount effective to depress the flotation of lead but not the flotation of cobalt.

4. The process according to claim 1 wherein the cobalt flotation is conducted in the presence of a non-water soluble glycol frother.

5. A process for the production of cobalt concentrate from an ore containing metal sulfides including sulfides of lead, zinc, and cobalt, the process comprising:

grinding the ore and mixing the ground ore with water to make an ore slurry;

subjecting the ore slurry to a lead cobalt flotation to produce a lead cobalt rougher concentrate and a zinc tailing slurry;

conditioning the lead cobalt rougher concentrate with causticized starch and sodium dichromate and sodium silicate in amounts effective to depress lead flotation;

adding a glycol frother and subjecting the conditioned lead cobalt rougher concentrate to froth flotation at a pH of less than about 5 to produce a cobalt rougher concentrate;

cleaning the cobalt rougher concentrate to produce cobalt concentrate.

6. The process according to claim 5 wherein the froth flotation is conducted at a pH of between about 4.5 and about 4.8.

7. The process according to claim 5 further comprising the step of adding $SO_2$ to the conditioned slurry to reduce the pH to less that about 5.

8. The process according to claim 5 further comprising the step of adding $SO_2$ to the conditioned slurry to reduce the pH to between about 4.5 and about 4.8.

9. The process according to claim 5 wherein the metal sulfides comprise galena, sphalerite, and siegenite.

10. A process for the production of cobalt concentrate from an ore containing metal sulfides including sulfides of lead, zinc, and cobalt, the process comprising:

grinding the ore and mixing the ground ore with water to make an ore slurry;

separating the lead and the cobalt from the zinc by depressing the zinc and floating the lead and cobalt in a froth flotation;

separating the cobalt from the lead by depressing the lead and floating the cobalt in a froth flotation;

subjecting the cobalt to at least one cleaning to produce a cobalt concentrate.

11. The method according to claim 10 wherein the pH during the cobalt froth flotation is less than about 5.

12. The method according to claim 11 wherein the pH during the cobalt froth flotation is between about 4.5 and about 4.8.

13. The method according to claim 11 wherein the lead is depressed by the addition of causticized starch.

14. The method according to claim 11 wherein the cobalt is floated by the addition of a non-water soluble glycol frother.

15. The method according to claim 14 wherein the lead is depressed by the addition of causticized starch.

16. The method according to claim 14 wherein the lead is depressed by the addition of causticized starch, sodium dichromate and sodium silicate.

17. The method according to claim 10 wherein the cobalt is subjected to at least three cleaning steps.

* * * * *